US007699104B2

(12) United States Patent
Tsilevich

(10) Patent No.: US 7,699,104 B2
(45) **Date of Patent: *Apr. 20, 2010**

(54) INTEGRATED SYSTEM AND METHOD FOR STEAM-ASSISTED GRAVITY DRAINAGE (SAGD)-HEAVY OIL PRODUCTION USING LOW QUALITY FUEL AND LOW QUALITY WATER

(76) Inventor: Maoz Betzer Tsilevich, 640 Woodbine Blvd., Woodbine, Southwest Calgary, Alberta (CA) T2W 4W4

( * ) Notice: Subject to any disclaimer, the term of this patent is extended or adjusted under 35 U.S.C. 154(b) by 212 days.

This patent is subject to a terminal disclaimer.

(21) Appl. No.: 11/752,813

(22) Filed: May 23, 2007

(65) Prior Publication Data

US 2008/0289821 A1 Nov. 27, 2008

(51) Int. Cl.
*E21B 43/24* (2006.01)

(52) U.S. Cl. ..... 166/272.3; 166/267; 166/403

(58) Field of Classification Search ..... None
See application file for complete search history.

(56) References Cited

U.S. PATENT DOCUMENTS 4,546,829 A 10/1985 Martin et al.
5,607,577 A * 3/1997 Koszarycz et al. ..... 208/391
6,357,526 B1 3/2002 Abdel-Halim et al.
6,454,010 B1 9/2002 Thomas et al.
6,536,523 B1 3/2003 Kresnyak et al.
6,988,549 B1 1/2006 Babcock
2003/0015458 A1 1/2003 Nenniger et al.
2003/0044299 A1 3/2003 Thomas et al.
2005/0145383 A1 7/2005 Nenniger et al.
2006/0042999 A1 3/2006 Iqbal et al.
2006/0243448 A1* 11/2006 Kresnyak et al. ..... 166/303

* cited by examiner

*Primary Examiner*—Zakiya W. Bates
(74) *Attorney, Agent, or Firm*—Egbert Law Offices PLLC

(57) ABSTRACT

A process for producing steam for extracting heavy bitumen includes the steps of mixing carbon or hydrocarbon fuel, the fuel being crude oil, vacuum residue, Asphaltin, or coke with an oxidation gas, the gas being oxygen, oxygen enriched air or air-combusting the mixture under high pressure and high temperature and mixing low quality contaminated water containing organics and inorganic with the combusted mixture so as to control combustion temperature and to generate steam. The liquid phase is transferred to a gas phase so as to contain steam and carbon dioxide. The solids are separated from the gas phase. The super heated dry steam and gas mixture is ejected into an underground reservoir.

19 Claims, 7 Drawing Sheets

DIRECT CONTACT STEAM GENERATOR WITH DIRECT CONTACT HEATER TO PRODUCE SUPER HEATED STEAM-GAS MIXTURE FOR OIL RECOVERY

DIRECT CONTACT STEAM GENERATION WITH SOLID REMOVAL

DIRECT CONTACT STEAM GENERATOR WITH DIRECT CONTACT HEATER TO PRODUCE SUPER HEATED STEAM-GAS MIXTURE FOR OIL RECOVERY

A SUPPLY OF AN UPGRADER BY - PRODUCT TO REMOTE LOCATED SAGD DIRECT CONTACT STEAM PLANT

EXISTING PRIOR - ART SAGD FACILITY WITH CO - GEN UNIT, AIR SEPARATION UNIT AND DIRECT CONTACT STEAM GENERATION UNIT

SYSTEM COMPRISING FROM SAGD FACILITY, CO - GEN FACILITY AIR SEPARATION FACILITY AND DIRECT CONTACT STEAM GENERATION FACILITY

FIG.6 A "STAND ALONE" DIRECT CONTACT SAGD FACILITY

A PRIOR ART SAGD WATER/OIL TREATMENT FACILITY WITH "ADD-ON" DIRECT CONTACT FACILITY

INTEGRATED SYSTEM AND METHOD FOR STEAM-ASSISTED GRAVITY DRAINAGE (SAGD)-HEAVY OIL PRODUCTION USING LOW QUALITY FUEL AND LOW QUALITY WATER

CROSS-REFERENCE TO RELATED U.S. APPLICATIONS

Not Applicable.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable.

REFERENCE TO AN APPENDIX SUBMITTED ON COMPACT DISC

Not Applicable.

BACKGROUND OF THE INVENTION

1. Field of the Invention

This application relates to a system and method that improves the SAGD facility with a system that can be added-on to an existing SAGD facility or as a new stand alone facility. The present invention relates to processes for producing steam from low quality rejected water containing high levels of dissolved inorganic solids or organics, such as oil.

Due to its simple direct contact, above ground adiabatic nature, combined with high pressure and temperature solid removal, the invention will minimize the amount of energy used to produce the mixture of steam and gas that is injected into the underground formation to recover heavy oil. This thermal efficiency minimizes the amount of greenhouse gases released into the atmosphere.

This thermal efficiency is achieved due to direct heat exchange. The condensed steam and the gases that will return back to the surface with the produced bitumen are at the temperature required for the oil recovery which is no higher than the underground reservoir temperature.

The present invention also relates to processes for making SAGD facilities more environmentally friendly by using low quality fuel and reducing the amount of greenhouse gas emissions by thermal efficiency and by injecting the $CO_2$ into the formation, where a portion will remain permanently.

2. Description of Related Art Including Information Disclosed Under 37 CFR 1.97 and 37 CFR 1.98

Steam injection into deep underground formations has proven to be an effective method for producing heavy oil. This is typically done by SAGD or by Cyclic Steam Injection (called "huff and puff"). In recent years, the SAGD method has become more popular, especially for heavy oil sand formations. Presently steam injection it is the only method that is commercially used on a large scale.

The present invention can be uses together with prior art processes currently used in upstream Upraders and down stream production facilities, which are currently in use by the industry, and adds the adiabatic direct contact steam and CO2 generation unit to reduce the disadvantages of the prior art and to allow for expansion with the use of a low quality water supply, the use of reject water from the existing facility and the use of low quality fuel supplies. There is also no need for high quality separation and purification downstream oil removal processes.

In the present invention, the exothermal reactions and the treatment of the injected gas mixture are done in an adiabatic control area above ground. The underground portion of oil production is very complex, with many unknowns as it was created over millions of years until it reached steady-state equilibrium. As was shown in other areas, one way to exploit resources and to produce products is by improving the organization and control. Since underground combustion processes change the chemistry of the reservoir, it is difficult to control and further complicates the already complicated underground reservoirs.

The injection of pure steam, or as a mixture with other gases, creates the minimum necessary increase in the underground formation disorder. It does not increase the complexity of the underground reservoir beyond the minimum required to mobilize the oil from the sand. This might be the reason why only injection of steam, or steam and other gases, are implemented and found to be commercially effective with SAGD.

The present invention is designed to be incorporated with SAGD. However, it can be useful with cyclic steam injection or with any other method for injection of steam into the ground. The main disadvantages of existing commercial SAGD are the main drivers.

SAGD consume large quantities of water to extract the heavy oil using steam. The water-to-oil ratio needed to produce the oil from the ground is in the range of 2-4 barrels of water to one barrel of oil. The current prior art technology requires relatively high water quality, as required by the once-through steam generators (OTSGs) or boilers for scaling prevention. The source water requires expensive purification processes that create sludge and reject water. As part of the recycled water treatment, all oil traces must be removed to treat the water both in lime softeners and evaporators and, as in the case of hot or warm lime softeners, significant amounts of waste sludge are created. The treatment requires significant purification of the water to prevent scaling in the steam generation units. Any oily emulsions must be broken down by chemicals or filters to a very high degree of separation. The process usually requires a stream of "reject water" from the blowdown that is injected into disposals wells or treated in an additional evaporators and crystallizers to evaporate the water from the reject water. Low quality, high TSS source water requires an expansive treatment facility and creates large amounts of sludge or disposal water. The oil producing companies are typically drawing water from an area which is much larger than the area from which the oil is produced. The water is pumped from relatively high aquifers to produce the best water quality available.

Due to environmental concerns regarding production of fossil fuels, a fossil water may be utilized. A fossil water is water that left the surface millions of years ago. Fossil water is found in deep underground formations and typically contains significant amounts of dissolved materials that make it unattractive for use by oil producers with current water treatment technologies as it is be far more expensive water treatment facility and produces large quantities of sludge and waste. There is a need to provide the oil producers with the ability to utilize fossil water while minimizing environmental impact.

The prior art SAGD required expensive water treatment plants and water de-oiling separation. This results in expensive facilities and chemicals to minimize oil traces in the recycled water. Reject water is produced and injected into disposal wells. In the case of lime softeners, sludge is produced as well. An increasing portion of the SAGD construction and operation costs is the cost of the water treatment plant. At present, the most widespread commercial water treatment process in the SAGD industry is the use of lime softeners. In this process, lime, magnesium oxide and other materials are used for removal of the dissolved solids in the form of a slurry. This process requires constant chemical supply and creates significant amounts of slurry waste resulting in landfill costs and environmental impacts. Different processes include evaporators that require water de-oiling and reject water that must be disposed of in disposal wells, or evaporated and crystallized to produce solid waste in additional facility. There is a need to be able to use oily water and water-oil emulsion for the production of steam so as to reduce the water treatment plant complexity and associated capital costs, and so as to reduce the amount of chemicals used. There is need to be able as part from the steam production process to cause the waste to be solid waste that is easy to handle.

SAGD consumes a large amount of heat energy. In most commercial SAGDs, natural gas is used as the energy source for the steam production. Natural gas is a valuable resource and the extensive use of it for producing oil is expensive with significant environmental impact. There is prior art that teaches the production of steam by other means. In some prior art, the steam is produced by burning some of the extracted heavy oil for the production of steam. This is a problematic process since there is a need for flue gas treatment prior to releasing it to the atmosphere. Another option combines upstream and downstream technologies in the form of an SAGD and upgrader that uses a gasification process to gasify the "barrel bottom" to produce syngas for the production of steam in the traditional way. Currently there is one commercial project that use this method. However, in the prior art, the steam generation is carried out by using co-generation, OTSG or boilers, where instead of burning natural gas for producing the steam, they burn the syngas as a source of energy. There is a need to use the heavy oil or the heavy asphaltin parts of the heavy oil for steam production.

In the prior art, a traditional gasifier is used to produce syngas. This is costly to install and operate and requires significant utilities to support it. The syngas is used as a fuel source to produce steam, using the traditional methods.

The SAGD technology consumes a significant amount of energy to produce the steam for the processes that are released to the atmosphere. The uses of OTSG, boilers or gas turbines with steam generation causes only a portion of the heat from the burning hydrocarbon to be injected underground to the reservoir. Flue gases and its carbon dioxide are released to the atmosphere. This issue becomes more and more significant due to global warming. There is a need to reduce carbon dioxide emissions as much as possible. The burning or gasification of other fuels or by-product waste will solve the problem of burning natural gas but it will not solve this issue since the amount of carbon dioxide released is equivalent to that released by burning natural gas. There is a need for minimizing the carbon dioxide release by: (1) using less steam; (2) producing the steam in an overall more efficient manner so as to minimize the aboveground heat losses; and (3) injecting the carbon dioxide with the produced steam to the reservoir where some of it will permanently remain. Down hole direct contact steam generators of the prior art produce steam by direct contact underground combustion process with water injection. These have several disadvantages. Any maintenance or cleaning requires a shut down of the wheel and drilling completion rigs to pull out the equipment. The water and fuel that is used must be of high quality so as to prevent the creation of solids that can plug the well over time. The maintenance of such systems is complicated. Any operation outside of optimal design conditions can have problems with corrosion and solids creation.

The above ground direct contact steam generators of the prior art generate reject water similar to the reject water generated by Once Through Steam Generation (OTSG). This system utilizes low quality water and low quality fuel. The reject water in the form of blowdown water can contain organic or inorganic materials. The blowdown can be either released to a disposal formation or crystallized to evaporate the remaining water. These prior art processes can not be integrated with prior art SAGD since they can not consume its reject flows or consume low quality solid fuels, such as coke or asphaltin.

It is an object of the present invention to provide a system and method that improves SAGD facilities by an add on to an existing SAGD facility.

It is another object of the present invention to provide a system and method that produces steam from low quality rejected water containing high levels of dissolved inorganic solids or organics.

It is another object of the present invention to provide a system and method that utilizes low grade fuel.

It is a further object of the present invention to provide a system and method that removes produced solids by converting the liquids to a gas phase under high pressures.

It is another object of the present invention to provide a system and method that minimizes the amount of energy used to produce the mixture of steam and gas that is injected into the underground formation to recover heavy oil.

It is a further object of the present invention to provide a system and method that minimize the amount of greenhouse gases that are released to the atmosphere.

It is still another object of the present invention to provide a system and method that enhance thermal efficiency as a result of direct heat exchange.

It is still a further object of the present invention to provide a system and method that serves to make the SAGD facilities more environmentally friendly by using low quality fuel and the reduction in greenhouse gases.

It is still a further object of the present invention to provide a system and method which minimizes water treatment costs.

These and other objects and advantages of the present invention will become apparent from a reading of the attached specification and appended claims.

BRIEF SUMMARY OF THE INVENTION

A process for producing steam for extracting heavy bitumen comprising the steps of: (1) mixing a low quality fuel containing at least heavy bitumen, solid hydrocarbons or carbons emulsion and oxidizing gas like Oxygen, enriched air or air; (2) combusting the mixture under high pressure and high temperature; and (3) mixing water with high total dissolved solids like silica clay or organics with the combusted mixture so as to control combustion temperature and to generate steam.

The step of combusting includes transferring the liquid phase to a gas phase, and separating the solids from the gas phase adiabatically so as to maintain the gas at the high temperature. The gas phase contains steam and carbon dioxide. The gas and steam are cleaned in a separator. The gas and steam are mixed with water of high temperature and pressure so as to produce saturated clean wet steam, and any remaining solids are scrubbed from the gas. The liquid phase is then separated from the gas phase. In the event that the gas contains sulfur, the process can include adding lime or dolomite during the step of scrubbing and then reacting the lime or dolomite with the sulfur.

The liquid phase and the remaining solids can be moved back to a combustion chamber. The liquid phase and remaining solids are heated in the combustion reactor so as to gasify the liquid phase and to remove the remaining solids. Corrosive contaminating gases are removed from the gas phase by commercially available packages designed for the specific gas composition on the specific location. The pressure of the clean wet steam is reduced to an injection pressure to transfer the steam from a saturated wet phase to a dry phase. Heat can be added to the steam so as to produce even a higher temperature of super heated dry steam and gas mixture. The pressure of the dry steam and gas mixture is between 800 and 4000 kpa. The temperature of the steam and gas mixture will be between 170° C. and 300° C. In an alternative form of the present invention, the step of adding heat includes directly contacting a reaction of hydrocarbon gas and oxygen so as to elevate the temperature of the dry steam and gas mixture to up to 400° C.

The super heated dry steam and gas mixture can be injected into an underground reservoir through a prior art commercially used SAGD horizontal injection well.

The low quality water can be the disposed water delivered from an existing SAGD facility. Similarly, the heavy bitumen can be received from the SAGD facility without processing therebetween. Fuel for the combusting process can be supplied from a remote upgrader in the form of a slurry with the upgrader reject water. This fuel can be coke, untreated "green" coke that removed from the delay cokers with out any additional processing or asphaltin. In particular, the solid fuel will be transported in the form of slurry where it is mixed with low quality water. It is pumped to a direct contact steam generator where it is injected to the combustion chamber with some of the transportation water a portion of the water recycled, and send back to be use again as the solid fuel transportation medium together with continuously new added make-up water.

DETAILED DESCRIPTION OF THE INVENTION

Figure 1:
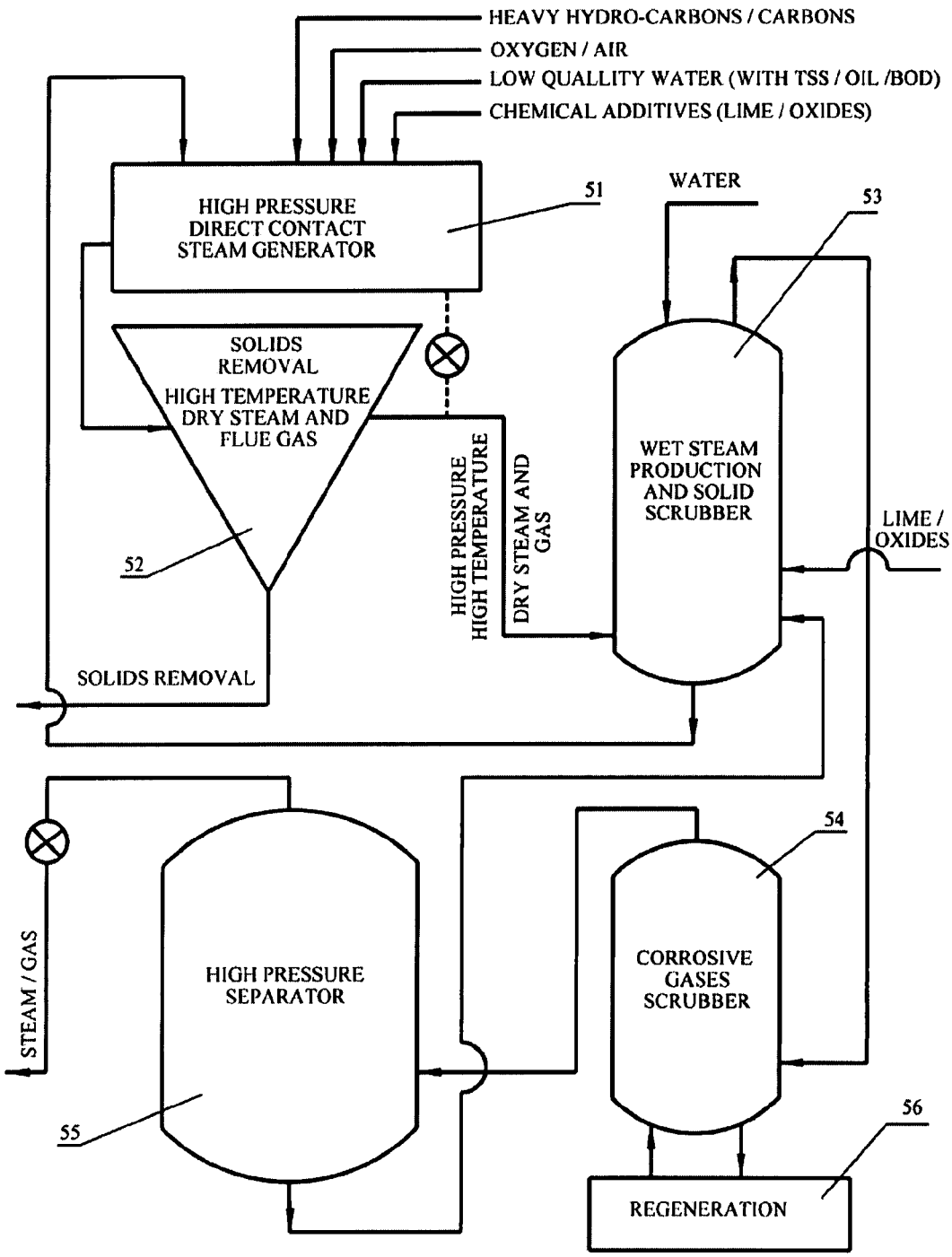
FIG. 1 is a schematic and diagrammatic illustration of the process of the present invention for full oxidation steam generation with dry solids removal.

FIG. 1 shows a first embodiment of the current invention where hydrocarbons such as untreated heavy low quality crude oil, VR (vacuum reside), asphaltin or coke, if available from upgrading process, is injected together with oxidation gas (oxygen, air or enriched air) to a combustion area of a high-pressure direct contact steam generator 51. Heat is released from the exothermic reaction. Water is injected to the combustion area 51 to maintain the high temperature under control to prevent damage to the facility while achieving full oxidation reaction of the carbon in order to minimize the amount of unburned carbon solids. An additional amount of water is injected to produce steam. The amount of water is controlled to produce steam where all the liquids with the soluble materials become solids and all liquids evaporate or burn to gas and solid ash. Additional chemical materials can be added to the reaction. As an example, limestone or magnesium oxide can be added to the water in a case where the fuel used is rich with sulfur. The gas and solids move to a high pressure solid separation block 52 where the solid phase is removed from the gas phase. This can done in a continues way or in intervals combined with pressure drops.

The high pressure, high temperature gas is mixed and washed through water 53 to remove the remaining solids and to produce wet steam. The rejected water and solids from this block are injected back into the steam generator 51. In the case where the water or the fuel includes a high percentage of impurities that react to produce unacceptable corrosive materials that can corrode the pipes and the well casing (high chlorine, sulfur etc), then an additional reaction block for corrosion control is added. The wet steam is injected to a high-pressure, high-temperature corrosive gas scrubber 54 where the water is circulated and re-generated at 56 to remove the remaining corrosive gases. This exact scrubbing and regeneration of the injected steam-gas mixture is chosen according to the impurities that appear in the water and the oil at the specific site. Those units are commercially available. It is important to emphasize that the purification treatment at this stage is not designed to allow the release of the gases to the atmosphere (which requires removal of most contaminates) but only to maintain the corrosive product at an acceptable level relative to the facility design. As an example, in a case in which stainless steel is be used for piping and casing, then even with heavily polluted fuel and water feeds there will be no need for block 54.

The steam and gas mixture flows to a high pressure separator block 55 where the steam and reaction gases are separated from the liquids and readied for injection into the reservoir. The condensations are injected back to the steam generator 51.

Figure 2:
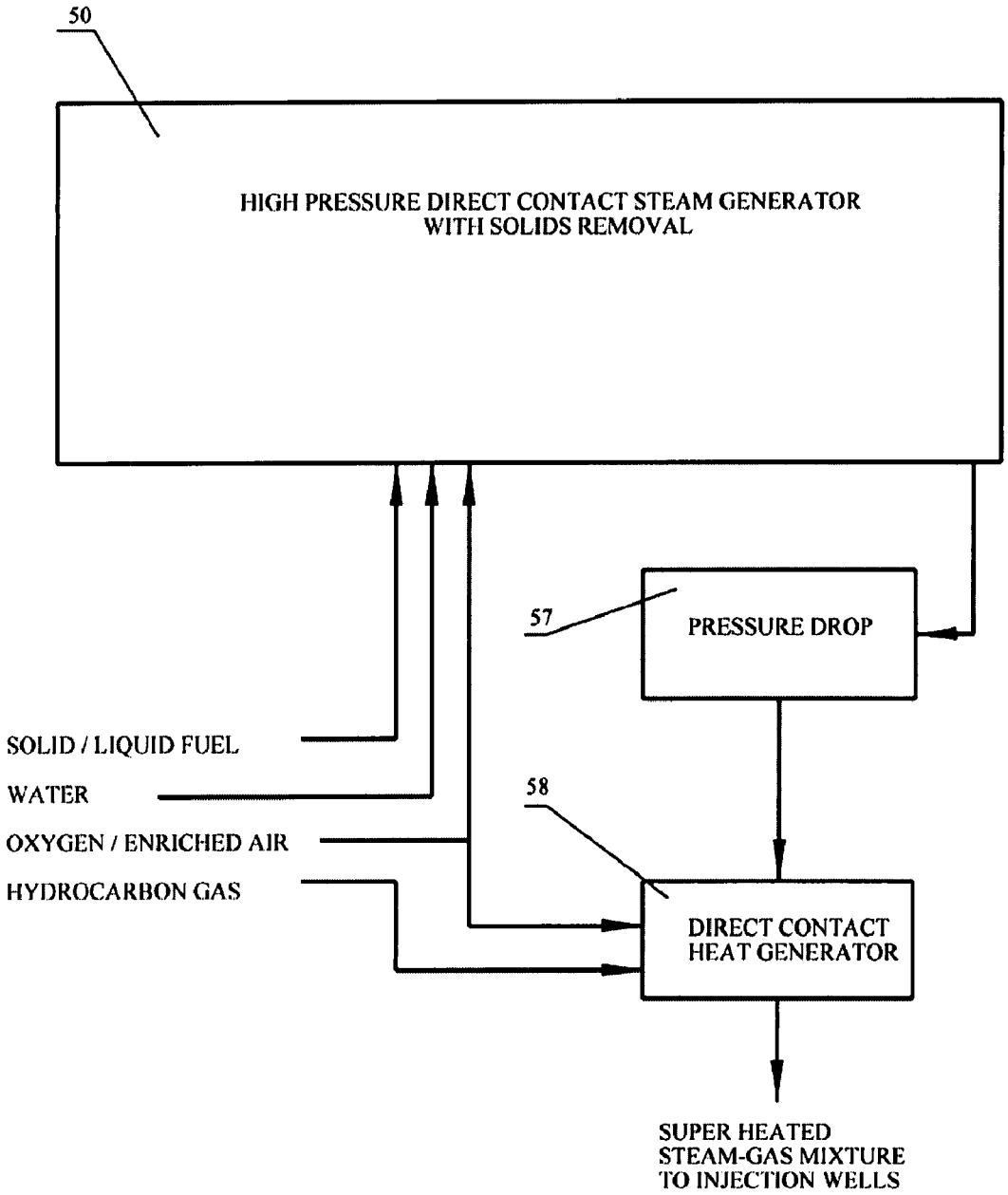
FIG. 2 is a schematic and diagrammatic illustration of the direct contact steam generator with direct contact heater for the production of a super heated steam/gas mixture for oil recovery.

FIG. 2 shows steam production block 50 (described in FIG. 1) that includes a solid removal block and an acid gas removal block. The pressure of the steam and gas mixture is dropped in block 57 to the range as required for injecting into the formation. An additional block 58 of direct contact heat generation is used to raise the temperature to produce a superheated steam and gas mixture. The direct contact heat generator uses oxygen or enriched air and hydrocarbon gas to produce a clean reaction and avoid the creation of solids. The extra heat results in raised temperatures that will be designed to prevent condensation in the pipe prior to the injecting into the formation. Condensation in the carbon dioxide rich environment will result in corrosion in the steam and gas pipes to the wells. The actual temperature of the superheated dry steam will be calculated to overcome the losses in the pipes to avoid condensation all the way through the entire length of the underground horizontal injection pipe. This block will be added only if the injection pressure is high enough such that dropping the pressure will not prevent the risk of condensation and corrosion.

Figure 3:
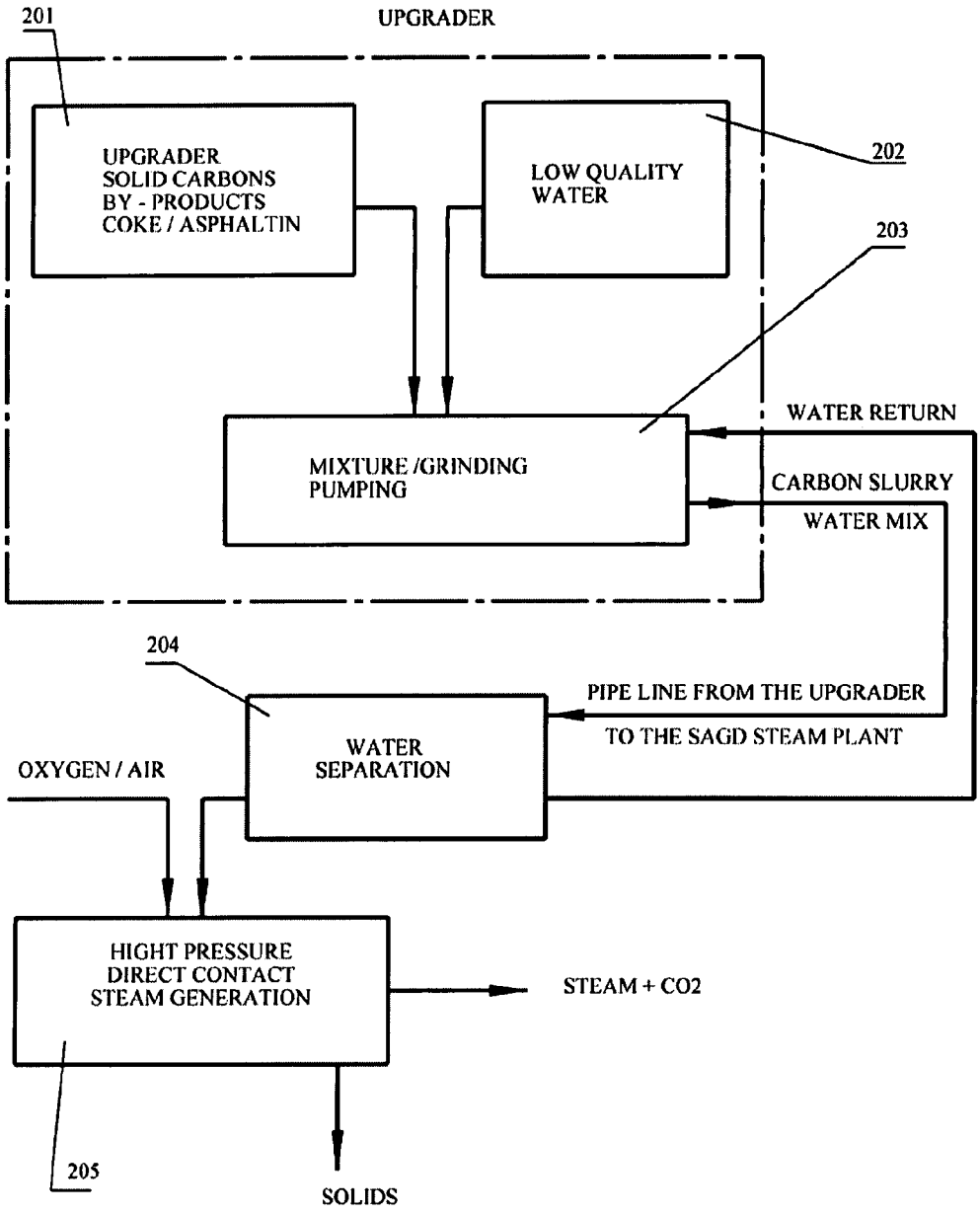
FIG. 3 is diagrammatic and schematic illustration of remote location SAGD steam production that uses upgrader by-products.

FIG. 3 shows the combination and the connection between the high pressure direct contact steam generator 205 and an upgrader, where the upgrader is in a remote location from the direct contact steam production facility and the SAGD. The solid fuel waste can be "green" coke from a delay coker or any other type of coke or asphaltin. The exact type of fuel depends on the upgrading processes used. A pipe system is used to send the solid fuel to the direct contact steam generator 205.

The solid fuel produced by the upgrader is ground to a grain size of less than six millimeters and mixed with recycled and process water in block 203. The slurry mixture is then pumped through a pipeline to a separator 204 that separates more then 60% of the water at the water separation station 204, and sends it back through the pipeline system back to the pumping station at the upgrader 203 where it will be added to the ground fuel with the make-up water and recycled back. In the SAGD location, after the excessive water is removed, the slurry is injected to the direct contact high pressure steam generator 205, together with oxygen or enriched air.

Figure 4:
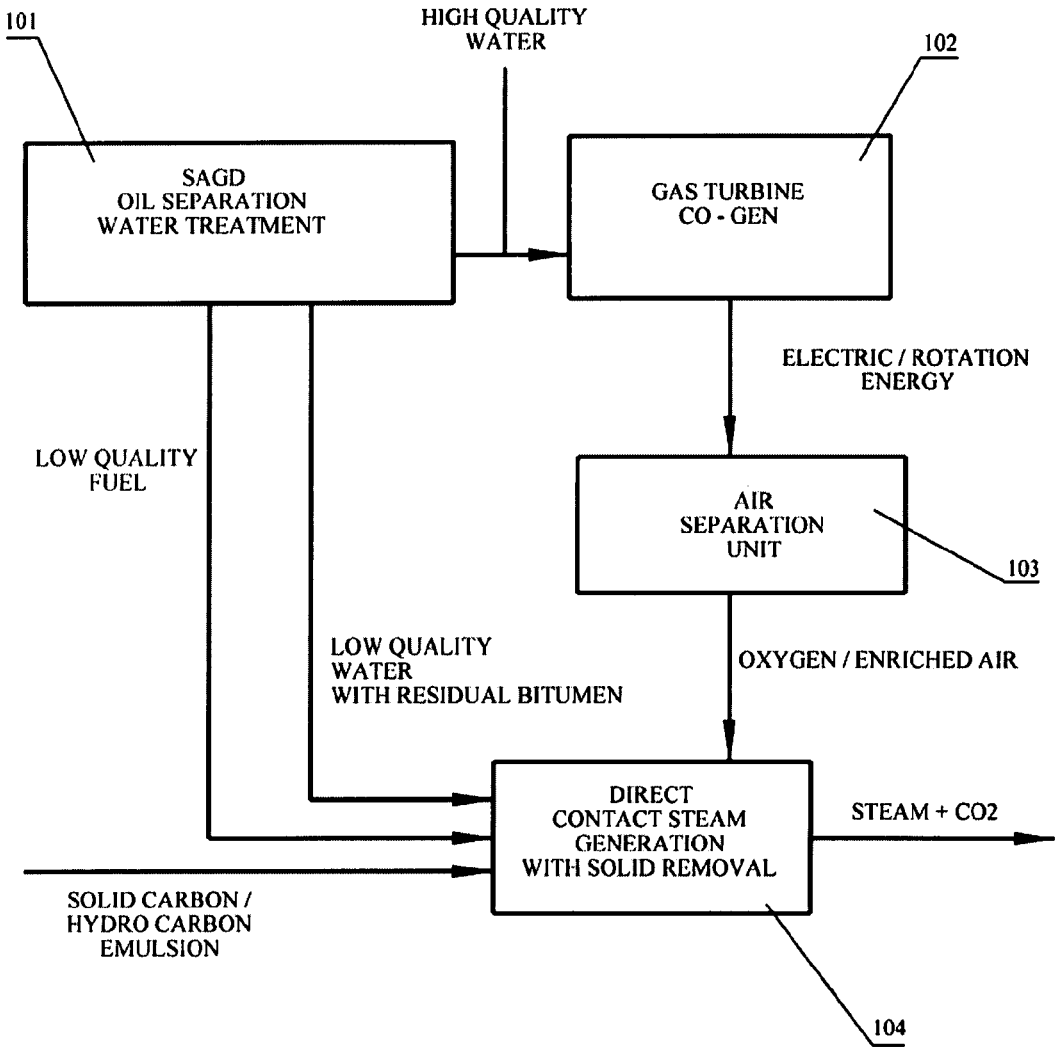
FIG. 4 is a block diagram showing the integration of the present invention with prior art SAGD facility with co-generation unit, air separation unit and the present invention direct contact steam generation unit.

FIG. 4 shows a system for supporting a SAGD facility, where the system is combined with a standard prior art SAGD water treatment facility. The system includes an air separation unit 103, a co-generator facility 102 to produce energy and steam, and an air separation facility to produce oxygen or enriched air and direct contact steam generation. The water treatment facility in the SAGD 101 provides high quality water to the co-generator 102 where energy and steam is produced. The energy produced in the co-generation is used to operate the air separation unit to produce oxygen or enriched air.

The oxygen or enriched air is injected into the high-pressure direct contact steam generator 104, together with water and fuel. The low-quality water contains residual bitumen emulsion with no further treatment. This prevents the need for expensive chemicals and facilities for the water purification emulsion separation. Any available hydrocarbon or coke can be used as fuel in the manner of the SAGD produced bitumen on-site or the solid carbons and/or heavy hydrocarbons shipped from an upgrader. The direct contact steam generator 104 produces mainly steam and carbon dioxide for downhole injection.

Figure 5:
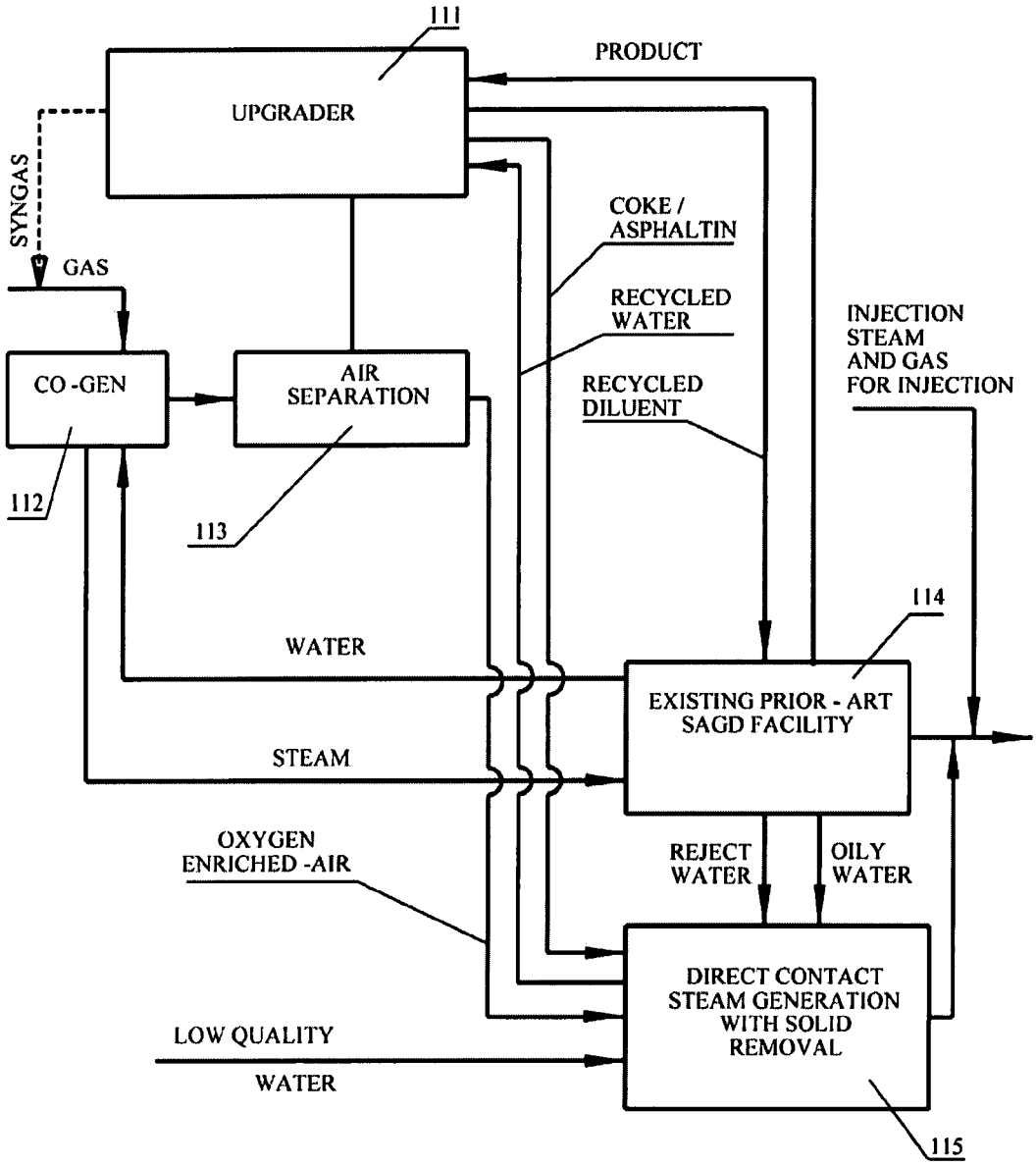
FIG. 5 is a block diagram showing the integration of the present invention with a prior art Upgrader and SAGD facility, a co-generation facility, air separation facility and the present invention direct contact steam generation facility.

FIG. 5 is the combination of FIG. 3 and FIG. 4. It shows a system, apparatus and method that incorporates a prior art existing and operating SAGD facility and an upgrader facility as part of an expansion of an existing SAGD and upgrader. The upgrader 111 receives the heavy oil product from an existing SAGD. As part of an expansion, an additional direct contact steam generation facility 115 is added in close proximity to the SAGD wells. This new facility consumes the reject water from the existing SAGD facility, currently disposed of in a disposal well, as well as additional oily water, most probably with an oil emulsion that will be rejected and sent directly to the new steam generator instead of being treated with chemicals to separate the remaining oil. A co-generation 112 will produce steam and energy to support an air separation unit 113. The air separation unit 113 will provide the oxygen or enriched air to the new steam generator 115. Most of the fuel for the new direct contact steam generator will be the upgrader by-product (such as coke) that will be sent in slurry form by using the pipe system.

The remaining energy produced by the co-generator 112 will be used by the upgrader or the SAGD utilities. The steam produced by the co-generator 112 will be sent to the existing SAGD 114. Most of the thermal expansion capacity in the SAGD portion will be due to the additional steam/CO2 mixture produced by the new direct contact steam generator in block 115. The waste from block 115 will be in a solid form that will prevent the need for disposal wells. The additional CO2 released to the atmosphere due to expansion will be minimized because the high thermal efficiency and because most of it will be injected directly into the reservoir where some of it will permanently stay.

Figure 6:
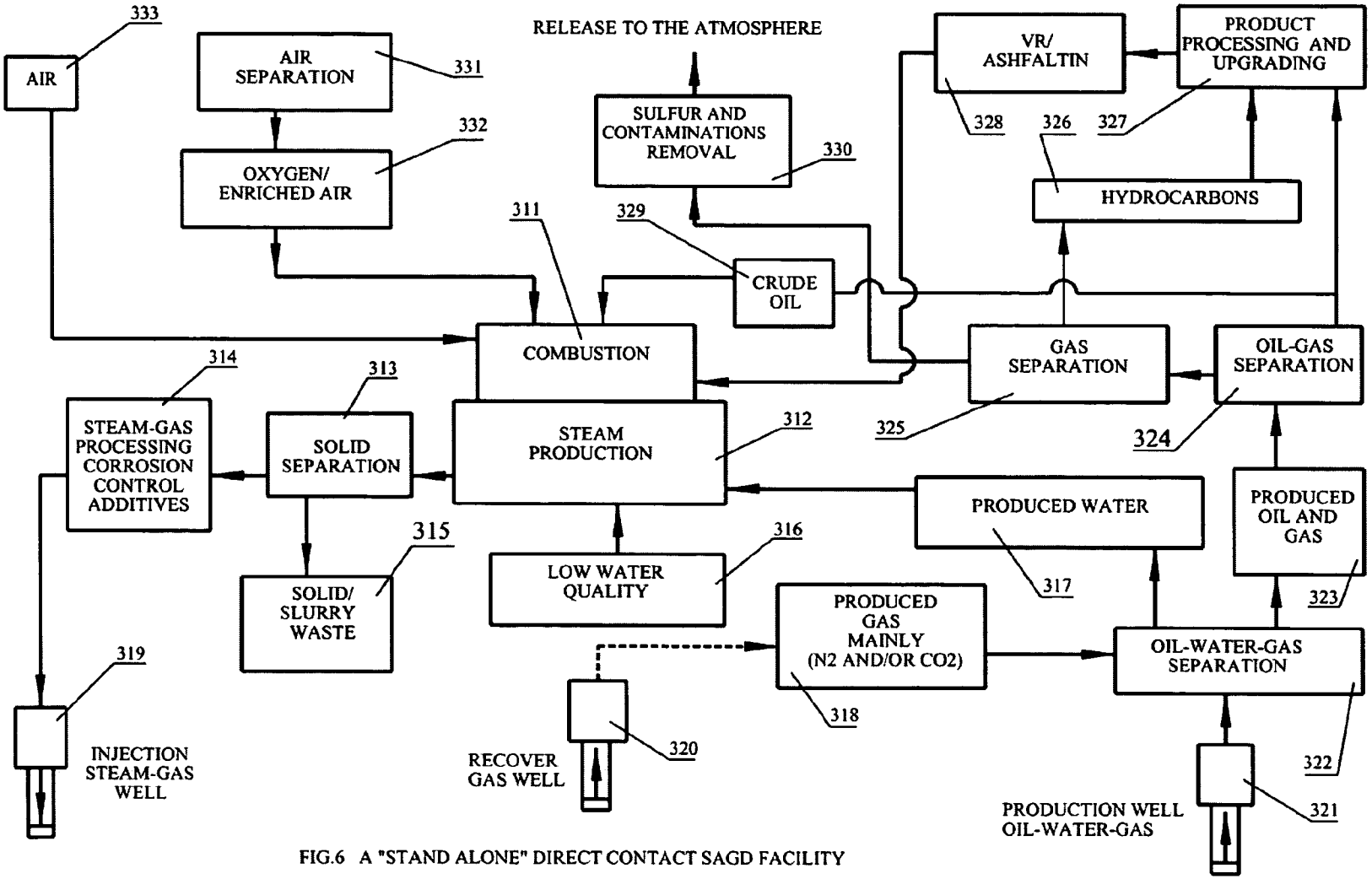
FIG. 6 is a block diagram showing the operation of a "stand alone" SAGD facility where all the steam is produced by the present invention direct contact process.

FIG. 6 shows a system and apparatus for supporting a new SAGD facility, where all the steam required for the oil production is produced in a direct contact steam generator without the traditional water treatment and the OTSG for generating the steam.

Water treatment is minimized as the direct contact process can use low quality water with organics such as oil. The product from the production well 321 flows to a separation process 322 where the oil is separated from the water to produce oil and gas 323. The separation process requirements are simpler and consume less chemicals. The acceptance of oil in the water reduces the complexity of the water treatment facility, the chemicals required to operate it and the operating costs when compared to the process used in the prior art OTSG or boilers. The produced water 317 with the oil traces and additional low quality make-up water 316 are injected to the steam production facility 312 where it is mixed with the hot gases produced from the burning fuel to produce the steam.

The produced oil and gas 323 separates the oil from the gas 324. The gas is further separated in a gas separation unit 325 into hydrocarbon products and non-valuable gases, such as nitrogen, carbon dioxide and possibly sulfur dioxide. The hydrocarbons 326 are sent to an upgrader for further processing 327. The non-valuable gases are treated to remove the sulfur and other contaminations 330 prior to release into the atmosphere.

In option I, an air separation unit 331 is used for producing a minimum of 75% oxygen enriched air 332 for injection into the pressurized combustion chamber. In option II, air is compressed 333 and injected to the combustion chamber under pressure. In option III, after the oil and gas separation, some produced crude oil 329 is sent to the combustion reactor 311 to produce flue gas and steam. In option IV, where upgrader products are available, then instead of using crude oil for the combustion, a VR (vacuum residue), extracted asphaltin or coke 328 will be used in the combustion chamber 311 for producing the steam and CO2 mixture.

In the combustion chamber, the fuels are mixed with the oxygen in an exothermic reaction. The produced water 317 is injected into the combustion chamber steam combustion section 312 together with make-up low quality water 316. From the steam production, a dry superheated steam is produced together with the solids resulting from the crude oil combustion and the low quality water that is used. The solids are separated in a solids separation unit 313. The solids are removed in a solid form or in a slurry form.

The produced steam and flue gas is treated at 314 to control and reduce the corrosiveness of the steam/flue gas mixture for injecting it into the injection wells. The necessity and characteristics of this unit is a function of the fuel quality, the water quality and the underground reservoir conditions. The product is recovered, together with water and gas, in the production well 321. In the case that air is used for the steam generation, or during the start-up/heat-up mode, then the flue gases are recovered through a separate well 320 or through a discharge pipe through the injection well itself to relief the underground pressure in the reservation.

Figure 7:
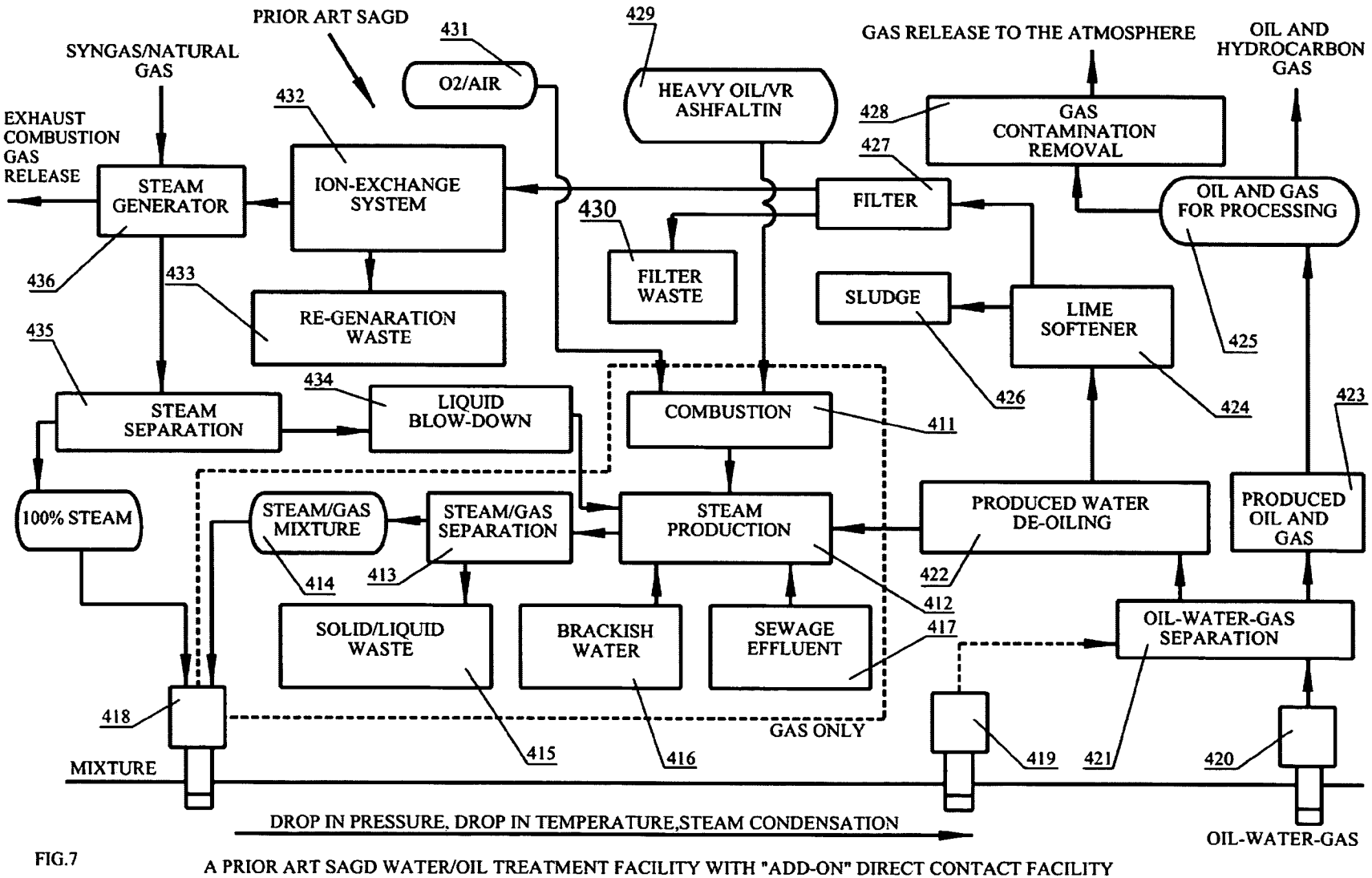
FIG. 7 is a block diagram showing the operation of an "add-on" to an existing prior art SAGD facility that includes hot lime softener water treatment.

FIG. 7 shows a system, an apparatus and a method for supporting and expanding a prior art SAGD facility. The system is combined with a standard prior art operating SAGD water treatment facility. In this prior art SAGD facility, steam is produced in steam generator 436. The steam for expansion will be produced using direct contact steam generators 411 and 412 where the steam is produced from water without treatment. This minimizes the investment in expanding the water treatment facility since the direct contact process can use low quality water with organics such as oil.

The product from the production well 420 is separated in block 421. This separation is simplified since there is no requirement to remove the oil from the water for the production of the steam or for the water disposal. The produced oily water will be used without any additional treatment in the direct contact steam generator unit 412. The produced oil and gas is sent for further processing in the existing prior art facilities. The produced gas is treated to remove contaminations, especially sulfur gas, before being released into the atmosphere. This process is required when using air for the steam production in the direct contact steam generator since this will result in a significant amount of produced nitrogen. The produced de-oiled water is then used for producing steam in the existing prior-art SAGD facility. The de-oiled water is pumped to the prior art lime softeners 424, where most of the dissolved solids are removed as a sludge 426. The soft water is pumped through filters 427 where a filter waste is produced at 430. The filtered water is treated in an ion-exchange system 432 where additional waste is generated at 433. The treated water is used for generating steam in a OTSG or a co-generator 436. Typically, an 80% steam is produced. This wet steam is separated in a steam separator 435 to produce 100% steam for downhole injection. The liquid blow-down that was disposed using disposal wells is used without any additional treatment in the new direct contact steam generator 412. The new direct contact steam generator can use heavy oil, VR, asphaltin or coke for the high pressure combustion. In addition, oxygen enriched air or air is injected for the combustion process 411. The steam is produced by high-pressure, direct contact between the hot combustion gases and the injected water. The water for the process is the produced water, brackish water 416 sewage effluent 417 or any type of available water.

From the steam production, a dry superheated steam is produced together with the solids resulting from the crude oil combustion and the low quality water that is used. The solids are separated in a separator 413 where the solids are removed. The steam/flue gas mixture 414 is injected into the reservoir with the steam produced in the prior art existing facility.

For further understanding of the present invention, the following is an example of the usage of the present invention. An existing SAGD facility located in Alberta produces heavy oil from the tar-sand. The produced bitumen is transferred by pipelines to an upgrader. The SAGD uses water from local water wells with a water treatment facility that is based on hot lime softeners or evaporators. The upgrader produces significant amounts of solid coke, currently with no commercial value. In addition there is approximately 10% of low-quality water rejected at the SAGD facility that is disposed back to an underground formation through a pipe system and disposal wells. There are waste water tanks and ponds that are used for holding process water, mostly water with fine clay particles that cannot be separated or re-used prior to long settling periods.

The advantages in the use of the present invention for the SAGD expansion over the existing technologies are as follows. First, there is a reduction of the $CO_2$ emissions due to the high thermal efficiency and the fact that the $CO_2$ is injected into the formation, the use of low quality waste water and the produced solid waste (a "zero" liquid discharged system) that can be easily discharged in local landfill, and the use of a low quality fuel, especially the use of coke as a fuel.

This cost effective and environmentally-friendly expansion with the implementation of the current invention is as follows. First, a direct contact steam generator is located at the SAGD area. This direct contact steam-generator will use oxygen or enriched air from an air separation unit to limit the amount of the uncondensed nitrogen gas injected to the underground formation. The feed for this system will be low-quality water, including untreated oily water from the existing SAGD or any available source. The fuel can be any locally available produced bitumen produced by the SAGD. The waste from the steam generation process will be in the form of solids. This makes it inexpensive to send to a landfill. The injected product will be a mixture of superheated steam, CO2 and other gases in the temperature and pressure similar to the existing facility which is in the range of 250 EC and 2000 kpa.

Secondly, the addition of a co-generator provides the energy for the air separation unit. Additional steam produced by the co-generator. The water to produce this steam is treated conventionally by expanding the existing water treatment facility in a traditional method which is hot/warm lime softeners or evaporators. The fuel will be the coke from the upgrader where the produced bitumen from the SAGD facility is treated. Because the coke material is located near the upgrader, and not near to the SAGD facility, the coke will be grind and mixed with the waste water from the upgrading process, settlement ponds water or from any other source. The slurry mixture will be transported using pipes to the direct contact steam generator, where the slurry will be injected to react with the oxygen/enriched air to produce the steam.

The present invention is a system and method for the production of steam for integration in a SAGD facility to produce hot gas. Mainly composed from steam, for downwell use from low grade fuel and water which minimizes the CO2 emissions and produces a dry solid waste. This is done by direct contact production of steam from low quality hard and oily water and fuel that can be untreated heavy oil, VR or coke. The process is adiabatic such that the produced gases maintain most of their thermal energy in the form of their temperature and pressure throughout the process and up to the point where they are injected into the reservoir. The direct contact steam generation process creates solid waste as result of the low quality water and fuel used. The high temperature and pressure separation and removal of the solids is a key stage for continuous operation. The separation is done when all or most of the liquids have already transferred to the gas so that it is done mainly between the solids and the gas phase. It can be done continually or in intervals with pressure drop to increase the evaporation and reduce the moisture in the solids waste. The gas purification stages (like scrubbing remaining solids and corrosive gases) are done under high pressure and under pressure where additional water is converted into steam. To minimize the corrosive effects of the CO2 in the injection gas and to minimize the requirement for special corrosion-resistant steel for deep high pressure wells, the gas mixture is further heated, preferably by a direct contact burner that heats the gas mixture to a temperature in which the steam is in "dry" super-heated state all the way to the underground formation through the horizontal perforated underground SAGD injection pipe. The steam condensates in the formation, outside of the injection pipe.

To minimize the amount of the nitrogen that is non-condensate gas with limited dissolvent in the reservoir, an air separation unit can be incorporated. The system can be integrated with prior art SAGD units. The integration allows for the use of reject water. It also allows for the reduction in the requirement for the water-oil separation process in the existing prior art SAGD since it allows rejection of the oily water emulsion that will be used as a water source for direct contact. The prior art SAGD technologies require full separation of the residual oil from the water. Both prior art water treatment technologies—the softening and the evaporating—require full removal of any residual oil. From the environmental perspective it is also impossible to release reject oily water to the environment or inject it to an underground water injection well. As a result, the water treatment process is expensive and requires expensive chemicals and filters. The ability to release a portion of the deeply emulsified oily water to another facility will be advantageous to the prior art SAGD.

The invention is intended to improve the advantages of the current processes used in SAGD and to reduce their disadvantages, especially the water quality and fuel quality. The present invention minimizes as much as possible, the greenhouse gas emissions. This application can be combined with an existing SAGD plant by using the low-quality rejected water and waste oil.

The present invention is intended to work with commercially proven SAGD technologies or similar designs and with the prior art for the use of steam and stimulating gases (e.g., $CO_2$) to recover the bitumen. Since the present invention does not deal directly with the subsurface formation, it can be further developed, engineered and tested remotely from the oil sand projects. The risk involved is decreased as the underground portion of the process is developed and proven. Because of the present amount of activities and development in the oil sand area, the ability to build and test new technologies or to construct new testing facilities in the oil sand regions are very limited and the costs are extremely high in comparison to the same activities carried out somewhere else. The current application pilot plant facility can be developed and built where human resources are available and in much lower cost compared to the costs in north Alberta where most of the oilsands deposits are located.

The heat efficiency of the injection is maximized, compared to indirect steam generation methods. This is due to the fact that the heat transfer occurs through direct contact and, in addition, the combustion gases transfer most of the thermal energy to the formation as the formation acts as a heat exchanger to the combustion gases. This results in higher heat efficiency compared to the standard manner of steam production where the heat in the combusted gases are released into the atmosphere at a much higher temperature.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A process for producing steam for extracting heavy bitumen, the process comprising the steps of:

mixing a low quality fuel with an oxidation gas, the fuel being selected from the group consisting of crude oil, vacuum residue, asphaltin and petroleum coke, said oxidation gas being selected from the group consisting of oxygen, oxygen-enriched air, and air;

combusting the mixture in a pressure and temperature controlled environment, wherein combustion pressure is similar to pressure of the produced steam and gas mixture;

mixing liquid phase water containing organic or inorganic materials so as to control combustion temperature after the step of combusting; and generating steam by direct contact heat exchange between the combusted mixture and said liquid phase water.

2. The process of claim 1, said step of combusting comprising:

transferring the liquid phase water from a liquid phase to a gas phase, said gas phase containing steam and carbon dioxide; and separating solids from said gas phase.

3. The process of claim 2, further comprising:

cleaning said gas and said steam from fine solids particles in a separator;

mixing said gas and said steam with saturated water of high temperature and pressure so as to produce a saturated clean wet steam and gas mixture;

scrubbing remaining solids from said gas;

separating the liquid phase from said gas phase; and recycling the water with the scrubbed solids back to for the step of mixing liquid phase water.

4. The process of claim 3, said gas containing sulphur, the process further comprising:

adding lime or dolomite during said step of scrubbing; and reacting the lime or dolomite with the sulphur.

5. The process of claim 3, further comprising:

removing corrosive contaminating gas from said gas phase; and injecting additives to said gas phase so as to protect the pipe from corrosion.

6. The process of claim 3, further comprising:

adiabatically reducing pressure of the clean wet steam and a carbon dioxide mixture to an injection pressure so as to produce dry stream in order to prevent condensation.

7. The process of claim 6, the pressure of said dry steam and gas mixture being between 800 and 4000 k.p.a.

8. The process of claim 6, the temperature of said dry steam and gas mixture being between 170° C. and 350° C.

9. The process of claim 3, further comprising:

adding heat to the steam and carbon dioxide so as to produce a superheated dry steam and gas mixture.

10. The process of claim 7, said step of adding heat comprising:

directly contacting and reacting hydrocarbon gas and oxygen to produce heat so as to elevate the temperature of the dry steam and gas mixture to up to 400° C. without a pressure drop.

11. The process of claim 9, further comprising:

injecting the superheated dry steam and gas mixture into an underground reservoir through a vertical or horizontal injection well.

12. The process of claim 1, wherein said liquid phase water is comprised of disposal water from a steam-assisted gravity drainage (SAGD) facility.

13. The process of claim 1, further comprising:

mixing heavy bitumen from a SAGD facility without processing therebetween.

14. The process of claim 1, said step of combusting comprising:

supplying fuel from a remote upgrader in the form of a slurry.

15. The process of claim 14, the fuel being solid petroleum coke or asphaltin, the process further comprising:

grinding and mixing the fuel with waste water so as to form a pumpable slurry.

16. The process of claim 15, further comprising:

pumping the slurry through a pipeline to a direct contact steam generator;

recycling a portion of the water therefrom; and injecting the fuel slurry to the combustion chamber.

17. The process of claim 1, further comprising:

producing energy and steam from high quality water by a cogeneration steam plant;

using the steam from the cogeneration steam plant to produce said oxidation gas for use in the combustion chamber;

using blowdown water from the cogeneration steam plant for a direct contact steam generator combustion chamber.

18. The process of claim 1, said oxidation gas being air, the process further comprising:

using the air as a combustion oxidizer in the combustion chamber;

adding additional relief wells so as to relive the non-dissolved and non-condensed gases to the surface;

treating the non-dissolved and non-condensed gases at a surface location; and releasing the treated gases to the atmosphere.

19. The process of claim 1, said oxidation gas being air, the process further comprising:

mixing water with the fuel prior to or during the step of combusting to control combustion reaction temperature and to generate steam.

* * * * *